US010801148B2

(12) United States Patent
Towner

(10) Patent No.: US 10,801,148 B2
(45) Date of Patent: Oct. 13, 2020

(54) CLOTHING WASHING, DRYING, AND FOLDING MACHINE

(71) Applicant: Kevin Towner, Colorado Springs, CO (US)

(72) Inventor: Kevin Towner, Colorado Springs, CO (US)

( * ) Notice: Subject to any disclaimer, the term of this patent is extended or adjusted under 35 U.S.C. 154(b) by 138 days.

(21) Appl. No.: 16/194,035

(22) Filed: Nov. 16, 2018

(65) Prior Publication Data

US 2019/0203395 A1 Jul. 4, 2019

Related U.S. Application Data

(60) Provisional application No. 62/612,793, filed on Jan. 2, 2018.

(51) Int. Cl.

| | |
|---|---|
| ***D06F 29/00*** | (2006.01) |
| ***D06F 18/00*** | (2006.01) |
| ***D06F 59/02*** | (2006.01) |
| ***D06F 89/00*** | (2006.01) |
| *D06F 58/12* | (2006.01) |
| *D06F 17/04* | (2006.01) |

(52) U.S. Cl.

CPC ..... *D06F 29/005* (2013.01); *D06F 18/00* (2013.01); *D06F 59/02* (2013.01); *D06F 89/00* (2013.01); *D06F 17/04* (2013.01); *D06F 58/12* (2013.01)

(58) Field of Classification Search

CPC ..... D06F 29/005

See application file for complete search history.

(56) References Cited

U.S. PATENT DOCUMENTS

2004/0000175 A1* 1/2004 Bolduan ..... D06F 17/04 68/5 D

OTHER PUBLICATIONS

CN103590229A, Zeng et al., Feb. 2014, English machine translation (Year: 2014).*

* cited by examiner

*Primary Examiner* — Jason Y Ko

(57) ABSTRACT

A clothing washing, drying, and folding machine that automates the entire laundry process includes a washing and drying unit and a folding unit. The washing and drying unit has a plurality of pressurized nozzles for directing a cleaning solution, derived from a water feed and a detergent feed, onto articles of clothing. A plurality of heating vents is then used to dry the articles of clothing. The folding unit has a folding machine that is then used to fold the articles of clothing. A clothing track system is utilized to hang the articles of clothing and transfer the articles of clothing from the washing and drying unit to the folding unit. The clothing track system includes a plurality of hanger supports dispersed along a guide rail, wherein each of the plurality of hanger supports may receive a clothing hanger.

18 Claims, 17 Drawing Sheets

CLOTHING WASHING, DRYING, AND FOLDING MACHINE

The current application claims a priority to the U.S. Provisional Patent application Ser. No. 62/612,793 filed on Jan. 2, 2018.

FIELD OF THE INVENTION

The present invention relates generally to laundering clothing. More specifically, the present invention is a clothing washing, drying, and folding machine that automates the entire laundry process.

BACKGROUND OF THE INVENTION

Many people dislike cleaning laundry, as it can be a frustrating and time-consuming task. Individuals may spend hours, washing, drying, steam cleaning, and folding laundry, leading many to become disinterested in the task due to the amount of effort required. Furthermore, multiple machines are frequently required to properly clean and dry laundry, leading to increased expense for the user. Additionally, many people misplace or lose articles of clothing, such as socks or underwear, when transferring articles of clothing between multiple machines, leading to the need to acquire replacements. Therefore, a single device that automates the cleaning and drying of laundry is desired.

It is therefore an object of the present invention to provide a clothing washing, drying, and folding machine. The present invention includes a washing and drying unit that is used to wash and dry laundry and a folding unit that is used to fold selected articles of clothing. Furthermore, the present invention includes a clothing track system that is used for hanging the articles of clothing and transferring the articles of clothing from the washing and drying unit to the folding unit. The clothing track system includes a guide rail and a plurality of hanger supports, wherein the plurality of hanger supports is dispersed along and slidably engaged with the guide rail. Each of the plurality of hanger supports provides a means for receiving a clothing hanger. The clothing hanger may include a grip-opening mechanism that engages with a hanger release mechanism of the folding unit to release the article of clothing onto a folding machine. Folded clothing is deposited into a laundry basket via a release gate.

DETAIL DESCRIPTIONS OF THE INVENTION

All illustrations of the drawings are for the purpose of describing selected versions of the present invention and are not intended to limit the scope of the present invention.

The present invention is a clothing washing, drying, and folding machine that automates the entire laundry process. In reference to FIG. 1-2, the present invention comprises a washing and drying unit 1, a folding unit 2, and a clothing track system 3. The washing and drying unit 1 provides a station for loading clothing and detergent. Furthermore, the washing and drying unit 1 provides a means for washing and drying the clothing. Meanwhile, the folding unit 2 provides a means for folding selected articles of clothing from the clothing loaded into the washing and drying machine. Finally, the clothing track system 3 provides a means for hanging the clothing and transporting the clothing from the washing and drying unit 1 into the folding unit 2.

Figure 2:
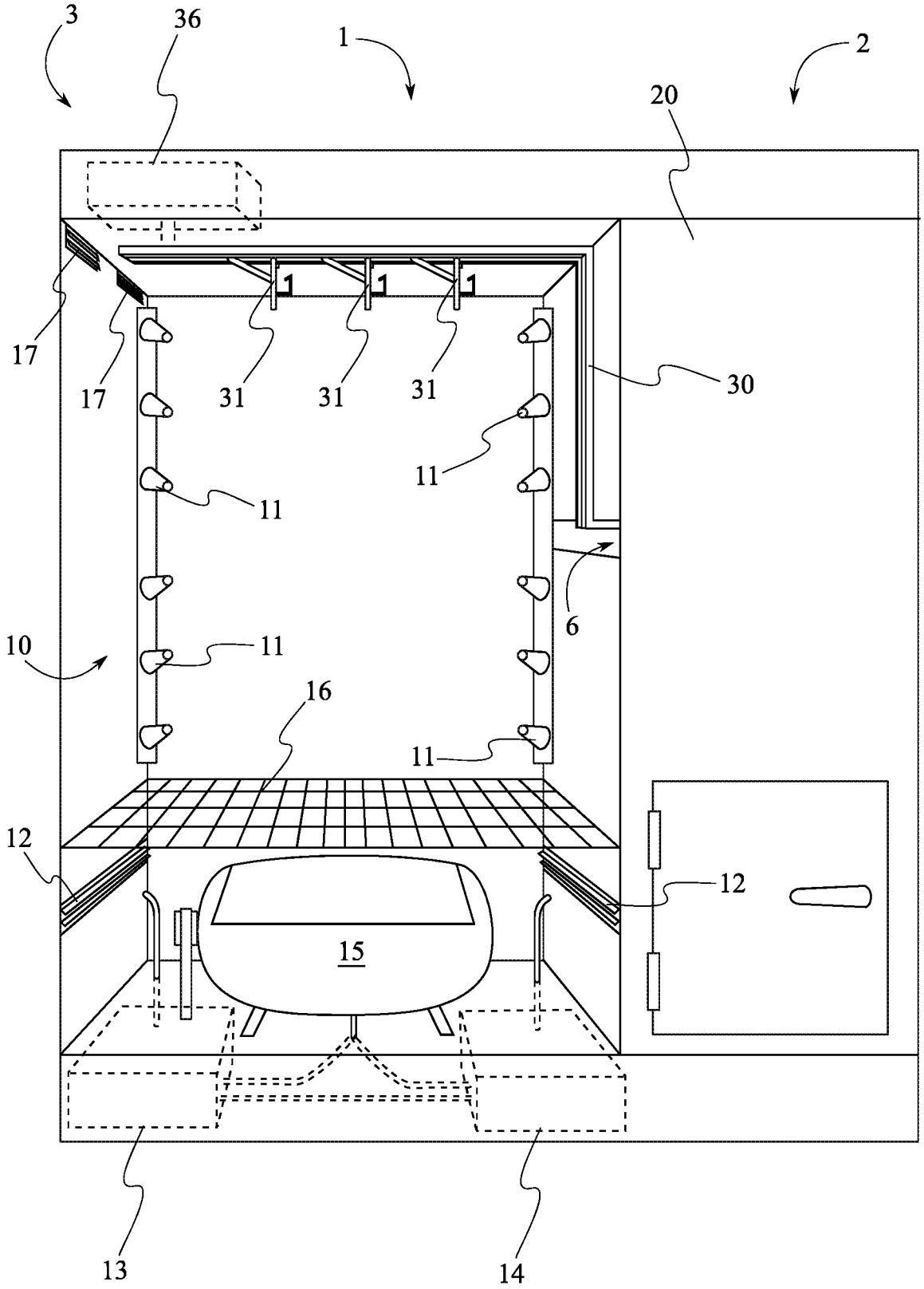
FIG. 2 is a perspective view showing the inside of the washing and drying chamber, wherein articles of clothing may be hung to be washed and dried.
Figure 3:
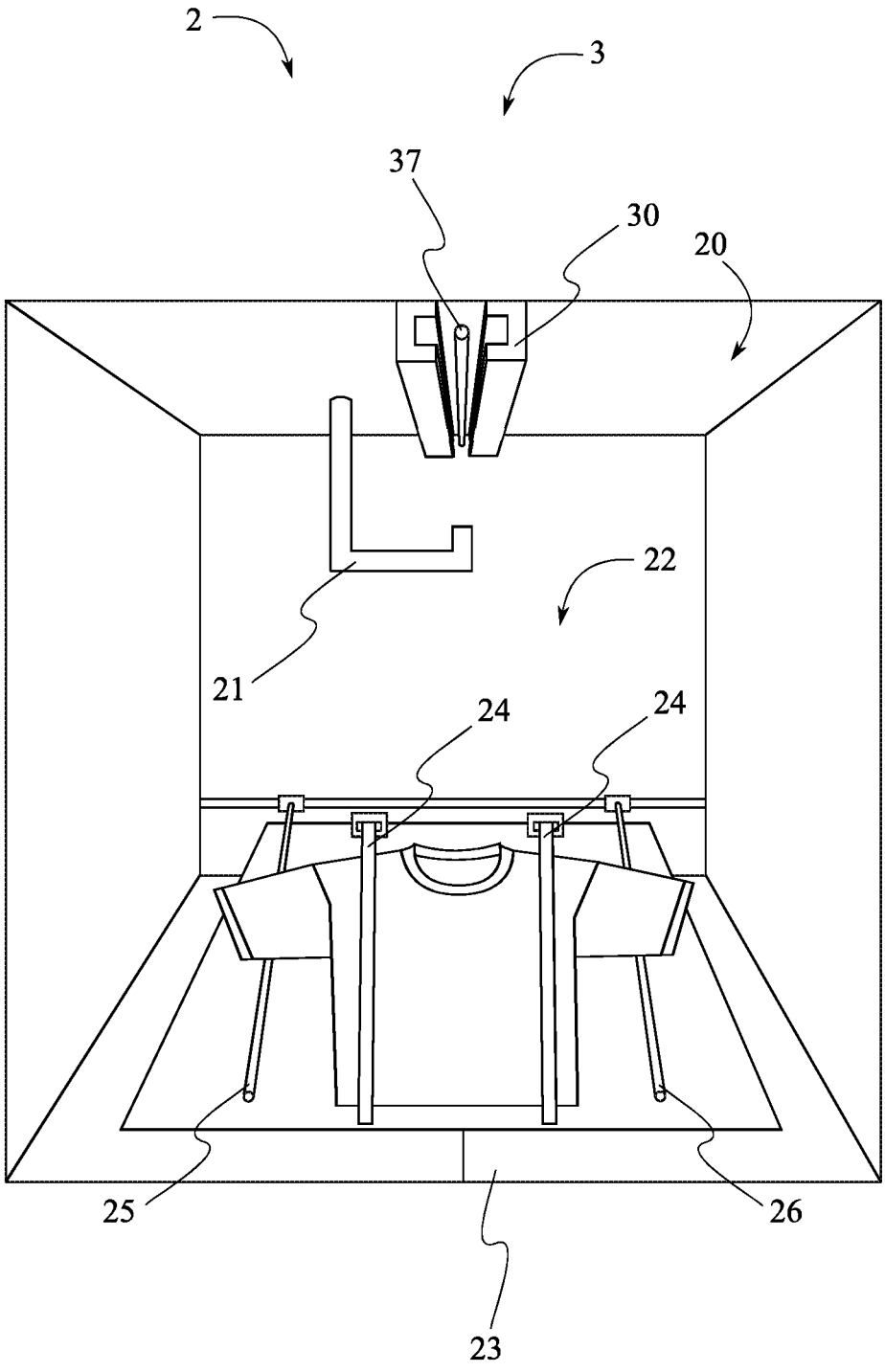
FIG. 3 is a perspective view showing the inside of the folding chamber, wherein the first manipulator and the second manipulator are positioned to fold the sides of an article of clothing inwards.
Figure 4:
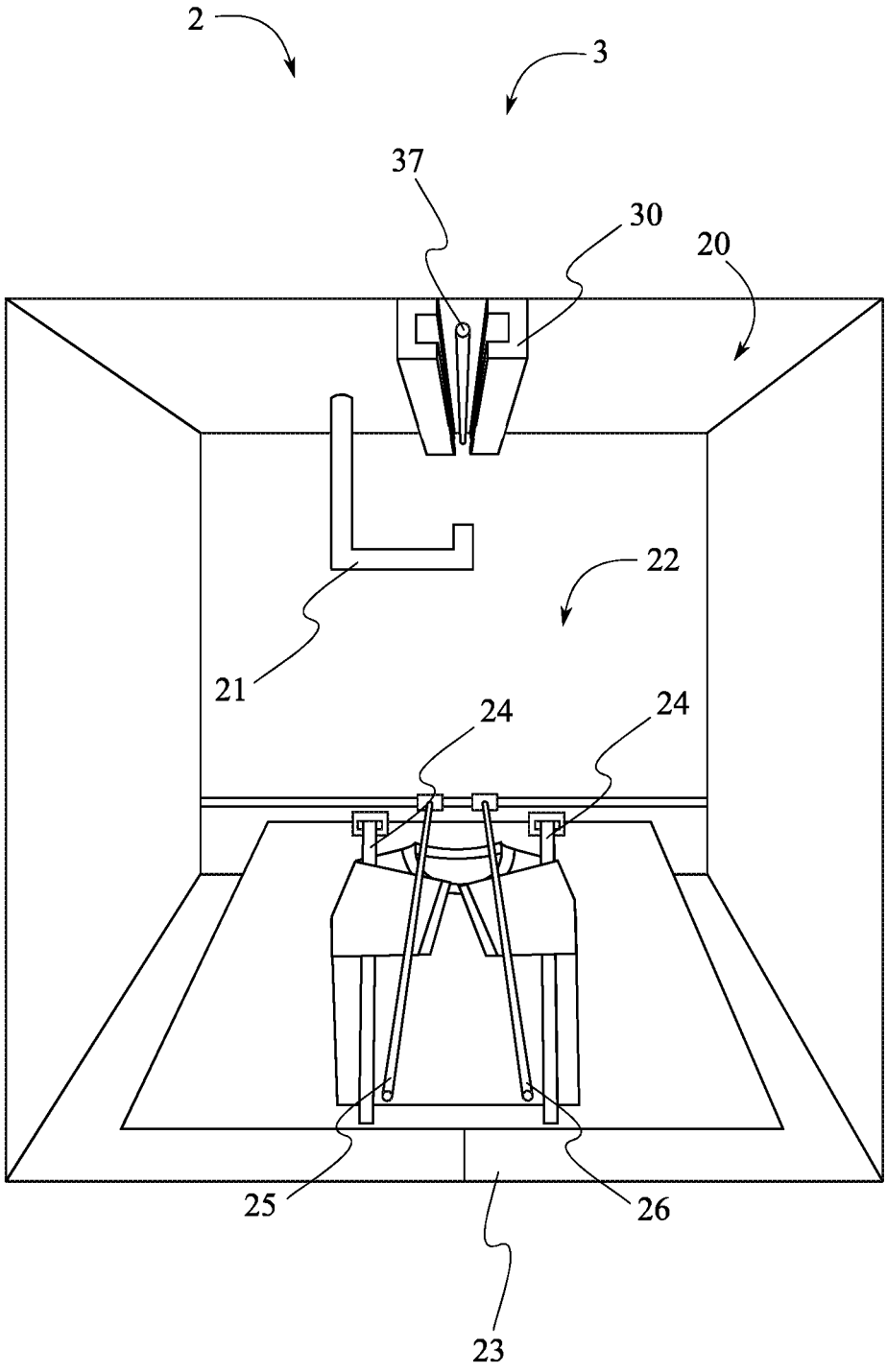
FIG. 4 is a perspective view showing the inside of the folding chamber, wherein the first manipulator and the second manipulator have folded the sides of the article of clothing inwards.

In reference to FIG. 2, the washing and drying unit 1 comprises a washing and drying chamber 10, a plurality of pressurized nozzles 11, a plurality of heating vents 12, a water feed 13, and a detergent feed 14. In the preferred embodiment, the washing and drying chamber 10 is a large wardrobe-like housing in which clothing can be hung. The washing and drying chamber 10 has an access door that provides a user with access to the interior of the washing and drying chamber 10 in order to insert and remove the clothing. The plurality of pressurized nozzles 11 and the plurality of heating vents 12 are integrated into the washing and drying chamber 10 to provide a means for washing the clothing and drying the clothing, respectively. Meanwhile, the water feed 13 and the detergent feed 14 are in fluid communication with the plurality of pressurized nozzles 11 in order to deliver and apply the formed cleaning solution to the clothing.

In further reference to FIG. 2, the plurality of pressurized nozzles 11 is positioned along the interior walls of the washing and drying chamber 10, wherein each of the plurality of pressurized nozzles 11 is directed inwards to spray the cleaning solution on the clothing. In some embodiments, the plurality of pressurized nozzles 11 is formed into sets of pressurized nozzles, wherein a row of pressurized nozzles is positioned along each corner of the washing and drying chamber 10. In other embodiments, the plurality of pressurized nozzles 11 may be separated into pairs of pressurized nozzles, wherein one of each pair of pressurized nozzles is positioned at the top of the washing and drying chamber 10 and the other pressurized nozzle from each pair of pressurized nozzles is positioned at the bottom of the washing and drying chamber 10.

In some embodiments, each of the plurality of pressurized nozzles 11 may be identical, while in other embodiments, each of the plurality of pressurized nozzles 11 may be dissimilar. In embodiments where each of the plurality of pressurized nozzles 11 is dissimilar, the plurality of pressurized nozzles 11 may include both high-pressure nozzles and low-pressure nozzles. The high-pressure nozzles are more suitable for dispensing water only, while the low-pressure nozzles are more suitable for dispensing either a solution of water and detergent or water only. In embodiments where each of the plurality of pressurized nozzles 11 is identical, each of the plurality of nozzles may have a variable spray pattern, variable drop size, spray angle, etc. The variable nature of the plurality of pressurized nozzles 11 allows the plurality of pressurized nozzles 11 to be adapted for both high-pressure and low-pressure applications and to be used with either water only or a water and detergent solution. Furthermore, in some embodiments, the orientation of each of the plurality of pressurized nozzles 11 is adjustable, such that the water or the cleaning solution can be selectively directed to a desired position within the washing and drying chamber 10.

The water feed 13 provides a means for connecting the washing and drying chamber 10 to a water source, such as a spigot or other plumbing fixture. The water feed 13 provides the appropriate plumbing components to direct an inflow of water from the water source to the plurality of pressurized nozzles 11. The plumbing components of the water feed 13 may include, but are not limited to, pipes, valves, tanks, tubing, and sealants. The washing and drying unit 1 may further comprise one or more pumps for delivering the water to either the plurality of pressurized nozzles 11 or the detergent feed 14. In some embodiments, the one or more pumps is a single pump, wherein the single pump or attached plumbing is capable of directing water to either the plurality of pressurized nozzles 11 or the detergent feed 14. In other embodiments, the one or more pumps is two pumps, wherein a first pump directs water to the plurality of pressurized nozzles 11 and a second pump directs water to the detergent feed 14.

Meanwhile, the detergent feed 14 provides a means for receiving a cleaning product and mixing the cleaning solution with water from the water feed 13 in order to form the cleaning solution. As such, the detergent feed 14 comprises the appropriate plumbing components to receive the cleaning product and mix the cleaning product with the water supplied through the water feed 13. The plumbing components of the water feed 13 may include, but are not limited to, pipes, valves, tanks, tubing, and sealants. The detergent feed 14 may be configured to accept liquid cleaning product and/or solid cleaning product, wherein one or more inlets is exteriorly integrated into the washing and drying chamber 10, allowing the user to insert the desired cleaning product. In some embodiments, the detergent feed 14 may include reservoir for storing a large quantity of cleaning product, wherein the amount of cleaning product utilized for each cleaning cycle is automatically regulated by the washing and drying unit 1.

The detergent feed 14 further comprises a means for mixing the cleaning product with the water in order to form the cleaning solution. As such, the detergent feed 14 may comprise one or more mixing tanks, wherein the one or more mixing tanks is in fluid communication with the water feed 13. Each of the one or more mixing tanks may include pumps, rotating blades, or other flow control devices that are used to mix the cleaning product with the water. The one or more pumps may be used to deliver the cleaning solution from the one or more mixing tanks to the plurality of pressurized nozzles 11, such that the plurality of pressurized nozzles 11 may dispel the cleaning solution onto the clothing within the washing and drying chamber 10.

In some embodiments, the washing and drying unit 1 further comprises a heating device. The heating device is used to increase the temperature of the water and/or the cleaning solution in order to reach a desired cleaning temperature. In some embodiments, the heating device may include one or more heating elements, wherein the one or more heating elements may be integrated with the water feed 13 and/or the detergent feed 14. For example, a first heating element may be integrated into a tank of the water feed 13 in order to heat the water as the water is fed to the plurality of pressurized nozzles 11, while a second heating element is integrated into a mixing tank of the detergent feed 14 in order to heat the cleaning solution as the cleaning solution is fed to the plurality of pressurized nozzles 11. In other embodiments, the heating device may include a heating tank, wherein the water and/or the cleaning solution is first directed to the heating tank from the water feed 13 and the detergent feed 14, respectively, before being heated and directed to the plurality of pressurized nozzles 11.

The plurality of heating vents 12 provides a means for drying the clothing that is hung within the washing and drying chamber 10. Preferably, the plurality of vents is positioned below the plurality of pressurized nozzles 11 or otherwise located towards the bottom of the washing and drying chamber 10, as depicted in FIG. 2. This allows the flow of heated air that is dispelled from the plurality of heating vents 12 to rise and thus evenly heat the interior of the washing and drying chamber 10. The plurality of heating vents 12 is integrated into the walls of the washing and drying chamber 10, such that each of the plurality of heating vents 12 provides an opening through which the heated air can be pumped into the heating and drying chamber. Each of the plurality of heating vents 12 may comprise a means for regulating the flow of heated air by increasing or decreasing the area of the opening.

In reference to FIG. 2, the washing and drying unit 1 may further comprise a plurality of pressure release vents 17. The plurality of pressure release vents 17 helps to maintain a normalized pressure within the washing and drying chamber 10. The plurality of pressure release vents 17 can be used to release excess steam, heated air, etc. from the washing and drying chamber 17. Similar to the plurality of heating vents 12, the plurality of pressure release vents 17 is integrated into the walls of the washing and drying chamber 10 and may comprise a means for regulating the release of pressure, steam, etc. by increasing or decreasing the area of the opening. Preferably the plurality of pressure release vents 17 is positioned about the top of the washing and drying chamber 10. However, it is possible for the plurality of pressure release vents 17 to be positioned otherwise. The plurality of pressure release vents 17 may be in fluid communication with one or more ducts, wherein the one or more ducts may divert the excess steam, air, etc. outside of a home or building.

In further reference to FIG. 2, in some embodiments, the washing and drying unit 1 may further comprise a washer and dryer cage 15 and a separation gate 16. The washer and dryer cage 15 is positioned below the plurality of pressurized nozzles 11, at the bottom of the washing and drying chamber 10. The washer and dryer cage 15 provides a means for washing and drying items that do not need to be hung up. As such, the washer and dryer cage 15 is in fluid communication with both the water feed 13 and the detergent feed 14. A spin belt may be used to transfer rotational motion of a motor to a washer spinner that is rotatably mounted within the washer and dryer cage 15. Furthermore, a cage heating element may be integrated with the washer and dryer cage 15 in order to dry the clothing. Alternatively, heated air may be directed from one or more of the plurality of heating vents 12 in order to dry the clothing.

Some embodiments are designed with a thermostat or temperature control system that is integrated between the washer and dryer cage 15 and the plurality of heating vents 12. Accordingly, the user is able to monitor and control the temperatures within the present invention. Additional embodiments are designed with a washer and dryer cage that is equipped with a removable hamper. The removable hamper may be slidably attached to the washer and dryer cage 15, such that the user can load or unload the washer and dryer cage 15 by sliding the removable hamper into or out of an interior compartment within the washer and dryer cage 15. In these embodiments, the washer and dryer cage 15 is equipped with an access door and a locking mechanism. The access door enables the user to load and unload the washer and drier cage 15. The locking mechanism secures the access door in a closed configuration while the washer and dryer cage 15 is in use.

The separation gate 16 is positioned in between the washer and dryer cage 15 and the plurality of pressurized nozzles 11. The separation gate 16 is pivotally connected to one of the walls of the washing and drying chamber 10, such that the separation gate 16 lifted to access the washer and dryer cage 15 and lowered to isolate the washer and dryer cage 15 from the plurality of pressurized nozzles 11. The separation gate 16 protects external and internal components of the washer and dryer cage 15 that are not supposed to get wet from coming in contact with either the water or the cleaning solution dispelled from the plurality of pressurized nozzles 11. The separation gate 16 may further be configured to divert the excess water or cleaning solution to a drain fixture within the washing and drying chamber 10.

Figure 1:
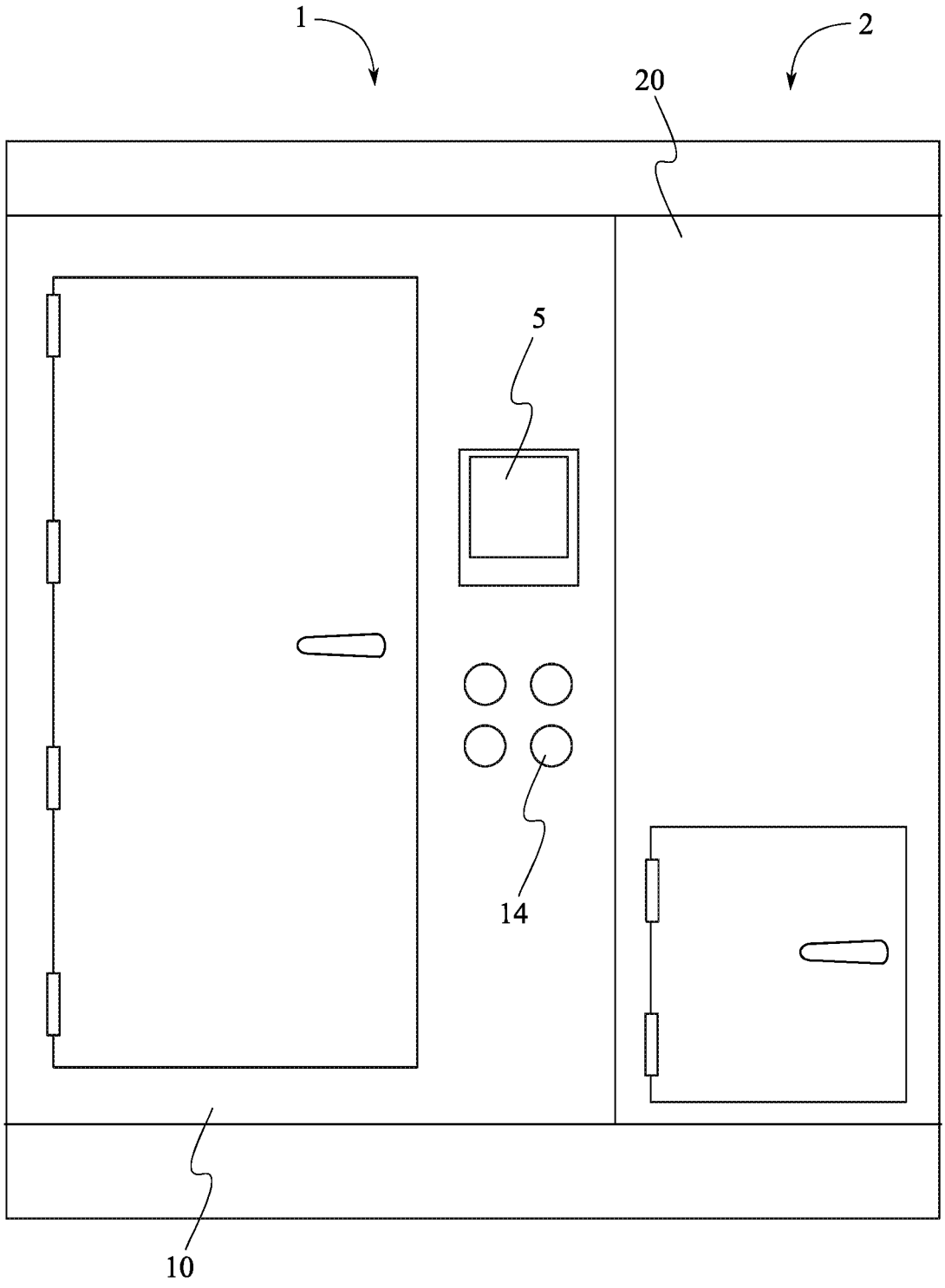
FIG. 1 is a front view of the present invention, wherein the washing and drying unit is positioned adjacent to the folding unit.

In reference to FIG. 3-6, the folding unit 2 is positioned adjacent to the washing and drying unit 1 and comprises a folding chamber 20, a hanger release mechanism 21, a folding machine 22, and a release gate 23. The folding chamber 20 has an access door, as depicted in FIG. 1, that provides entry to the interior of the folding chamber 20 and allows the user to retrieve the folded clothing. The hanger release mechanism 21, the folding machine 22, and the release gate 23 are positioned within the folding chamber 20, wherein the folding machine 22 is positioned in between the hanger release mechanism 21 and the release gate 23. The hanger release mechanism 21 provides a means for releasing articles of clothing from the clothing track system 3 onto the folding machine 22. Meanwhile, the folding machine 22 provides a means for folding articles of clothing as the articles are released from the clothing track system 3. The release gate 23 allows the folded clothing to be transferred from the folding machine 22 to a laundry basket or other receptacle positioned below the folding machine 22.

The folding machine 22 comprises a first plurality of folding arms 24 and a second plurality of folding arms 27, wherein the first plurality of folding arms 24 is positioned perpendicular to the second plurality of folding arms 27. The first plurality of folding arms 24 and the second plurality of folding arms 27 are utilized to manipulate the article of clothing into the desired folded configuration. In reference to FIG. 3-4, in some embodiments, the first plurality of folding arms 24 may include a first manipulator 25 and a second manipulator 26, while the second plurality of folding arms 27 may include a third manipulator 28. The first manipulator 25 and the second manipulator 26 are laterally offset from each other, such that the first manipulator 25 and the second manipulator 26 are positioned on opposite sides of the article of clothing. The first manipulator 25 and the second manipulator 26 are laterally actuatable within the folding chamber 20 in order to fold the sides of the article of clothing inwards. The first manipulator 25 and the second manipulator 26 may be actuatable in a linear fashion or in a pivotal manner in order to fold the article of clothing.

Figure 5:
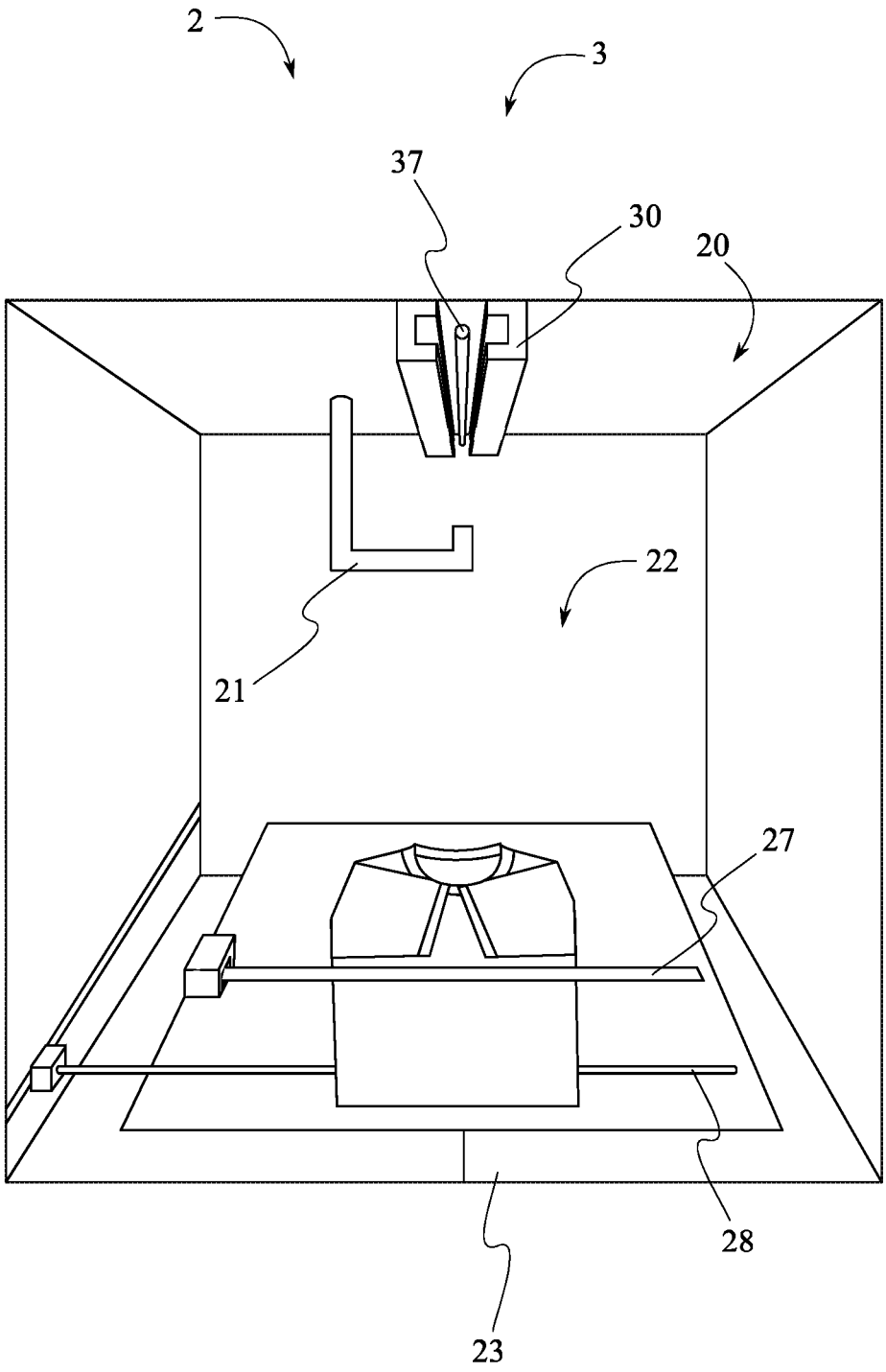
FIG. 5 is a perspective view showing the inside of the folding chamber, wherein the third manipulator is positioned to fold the bottom half of the article of clothing over the top half of the article of clothing.
Figure 6:
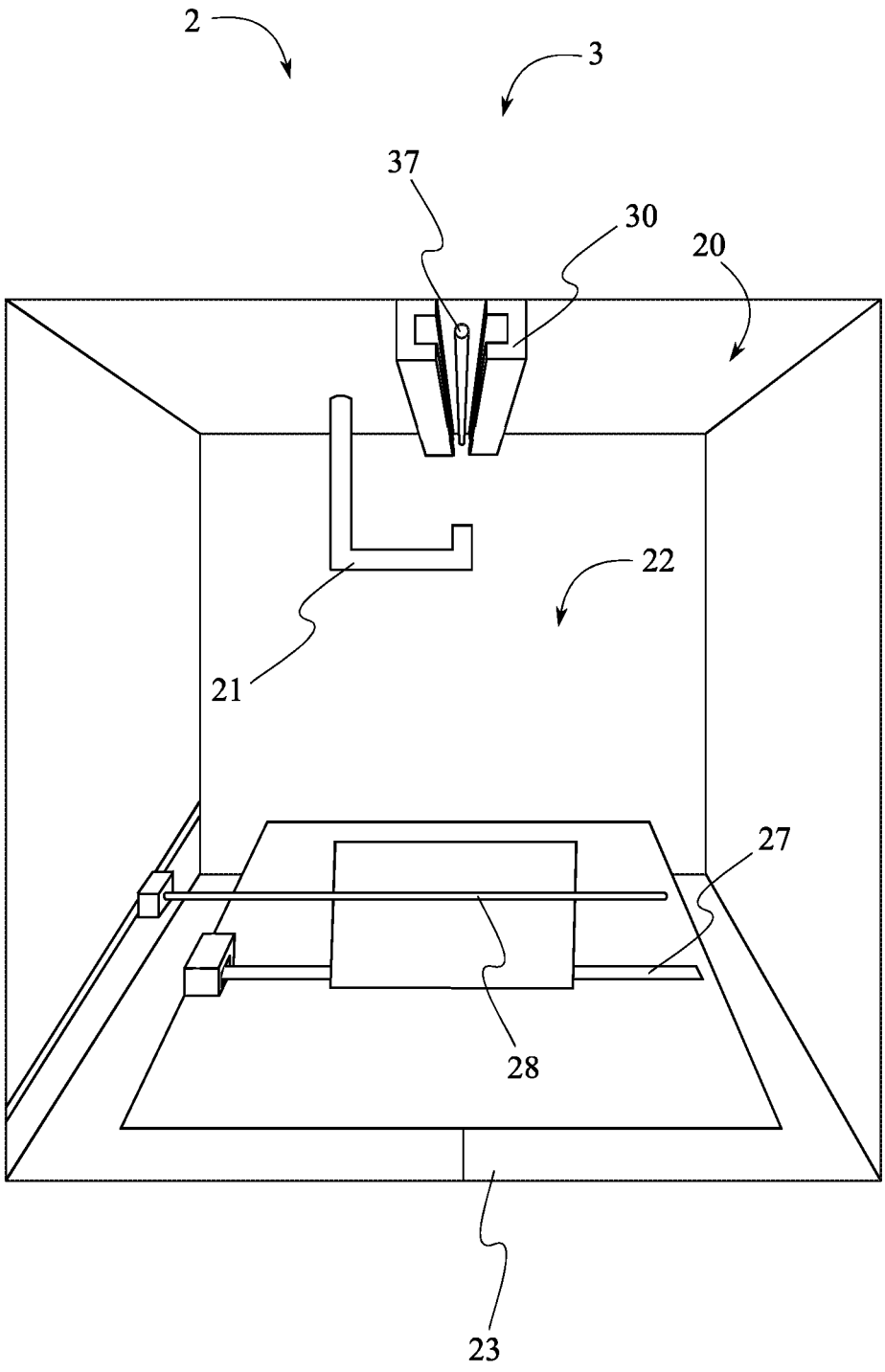
FIG. 6 is a perspective view showing the inside of the folding chamber, wherein the third manipulator has folded the bottom half over the top half.

Similarly and in reference to FIG. 5-6, the third manipulator 28 is laterally actuatable within the folding chamber 20, wherein the third manipulator 28 folds the top and bottom of the article of clothing inwards. The third manipulator 28 may be actuatable in a linear fashion or in a pivotal manner in order to fold the article of clothing. The first plurality of folding arms 24 and/or the second plurality of folding arms 27 may further comprise on or more stabilizing arms. The one or more stabilizing arms is utilized to hold down portions of the article of clothing in order to prevent the article of clothing from sliding around, or otherwise being displaced, as the first manipulator 25, the second manipulator 26, and the third manipulator 28 fold the article of clothing. Once the article of clothing has been folded, the one or more stabilizing arms is retracted or otherwise disengaged from the article of clothing, allowing the article of clothing to be dropped through the release gate 23 into the laundry basket.

The release gate 23 is actuated once the folding machine 22 has completed the process of folding the article of clothing. In some embodiments, the release gate 23 may be a single panel that is manipulated in order to allow the article of clothing to pass through. In other embodiments, the release gate 23 may include multiple panels that are manipulated in order to allow the article of clothing to pass through. In yet other embodiments, the release gate 23 may further assist in lowering, dropping, to otherwise depositing the article of clothing into the laundry basket.

In reference to FIG. 2, the clothing track system 3 allows the user to hang a number of articles of clothing within the washing and drying chamber 10. Furthermore, the clothing track system 3 is utilized to transfer selected articles of clothing from the washing and drying chamber 10 to the folding chamber 20. In order to hang and transfer the articles of clothing, the clothing track system 3 comprises a guide rail 30 and a plurality of hanger supports 31, wherein the plurality of hanger supports 31 is linearly dispersed along the guide rail 30. The guide rail 30 traverses from the washing and drying chamber 10 into the folding chamber 20, thus allowing the articles of clothing to be transferred from the washing and drying chamber 10 to the folding chamber 20. The articles of clothing can be hung via the plurality of hanger supports 31, such that the articles of clothing can first be washed and dried within the washing and drying chamber 10 and then transferred to the folding chamber 20 to be folded.

Figure 17:
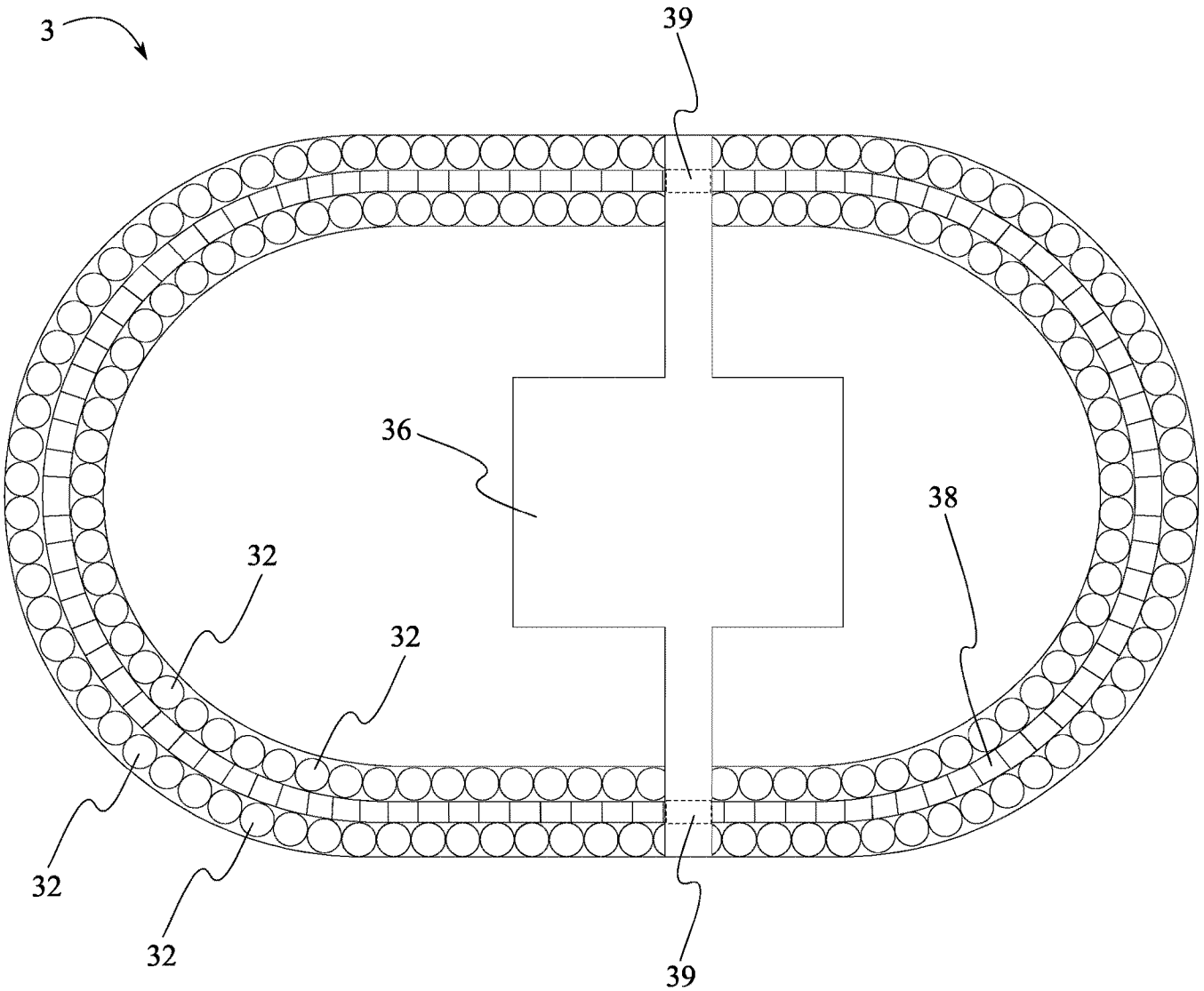
FIG. 17 is a top view of the clothing track system that is formed into a continuous loop.

In some embodiments, the clothing track system 3 further comprises a motor 36, as depicted in FIG. 2 and FIG. 17, that is used to drive the plurality of hanger supports 31 along the guide rail 30. The motor 36 is mechanically coupled to the guide rail 30 in order to convert rotational motion of the motor 36 to linear motion along the guide rail 30. Preferably, the motor 36 is housed above the washing and drying unit 1 and the folding unit 2. However, it is possible for the motor 36 to be located elsewhere in embodiments of the present invention. The guide rail 30 can be configured as a closed loop or point-to-point track. In a closed loop configuration, the motor 36 may be rotatable in a single direction or in two directions. In a point-to-point track configuration, the motor 36 is preferably rotatable in two directions in order to drive the plurality of hanger supports 31 back and forth. However, it is possible for other devices to be used in conjunction with the motor 36 in order to provide a return force, thus allowing the motor 36 to provide rotational means in one direction.

In the closed loop configuration, the plurality of hanger supports 31 is positioned within the washing and drying chamber 10. Each of the articles of clothing is then loaded onto a corresponding hanger support from the plurality of hanger supports 31. Once the washing and drying sequence has been completed by the washing and drying unit 1, each of the selected articles of clothing that need to be folded is directed into the folding chamber 20 through a clothing transfer opening 6. The clothing transfer opening 6 is a horizontal slot in the walls between the washing and drying chamber 10 and the folding chamber 20, wherein the selected articles of clothing can be pulled through the clothing transfer opening 6. In some embodiments, a transfer door may be integrated with the clothing transfer opening 6, wherein the transfer door allows for selective access into the folding chamber 20. A hanger exit opening is also provided, wherein the hanger exit opening allows the plurality of hanger supports 31 to be transferred back into the washing and drying chamber 10 from the folding chamber 20.

In the point-to-point configuration, the plurality of hanger supports 31 is positioned within the washing and drying chamber 10. Each of the articles of clothing is then loaded onto the corresponding hanger support from the plurality of hanger supports 31. Once the washing and drying sequence has been completed by the washing and drying unit 1, each of the selected articles of clothing that need to be folded is directed into the folding chamber 20 through the clothing transfer opening 6. Once each of the selected articles of clothing has been released and folded, the plurality of hanger supports 31 is returned to the washing and drying chamber 10 through the clothing transfer opening 6.

Figure 7:
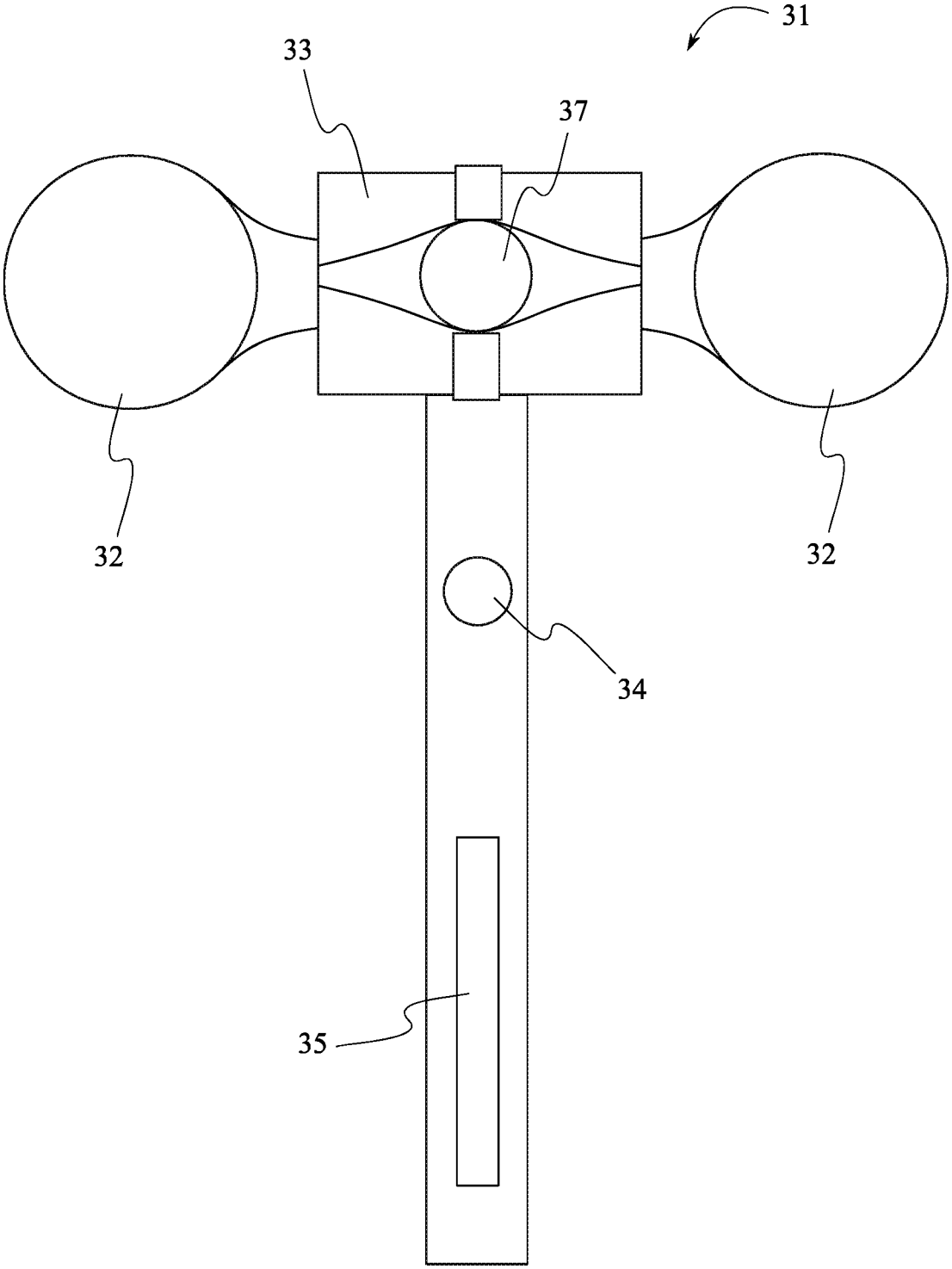
FIG. 7 is a front view of one of the plurality of hanger supports, wherein the rail stop is clamped around the guide cable.
Figure 8:
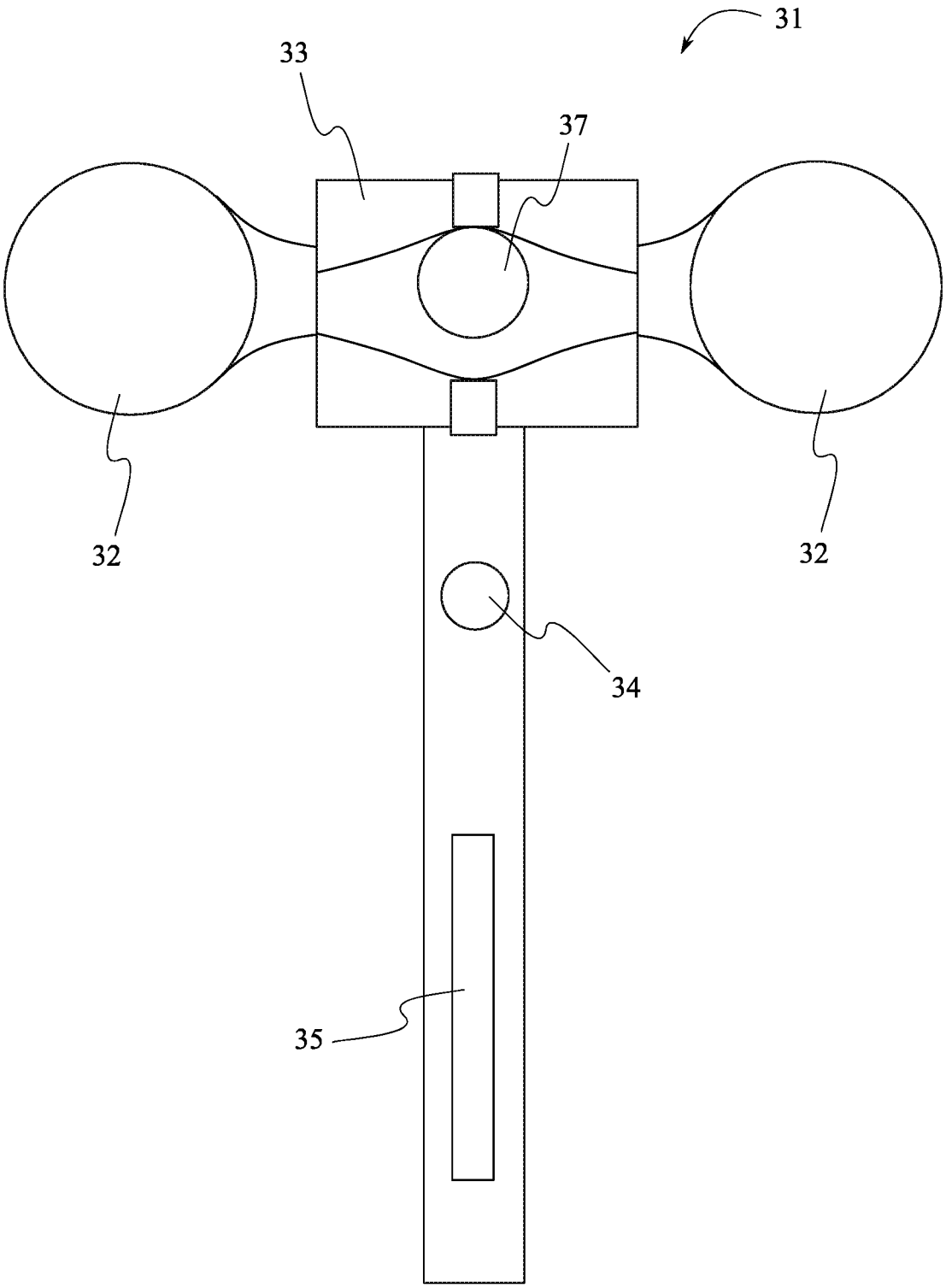
FIG. 8 is a front view of one of the plurality of hanger supports, wherein the rail stop is unclamped from the guide cable.

In reference to FIG. 7-8, in some embodiments, each of the plurality of hanger supports 31 comprises a pair of ball bearings 32, wherein each of the pair of ball bearings 32 is slidably engaged with the guide rail 30. The guide rail 30 includes a pair of channels into which the pair of ball bearings 32 is correspondingly engaged. Each of the pair of channels is offset from the other, creating a gap into which each of the plurality of hanger supports 31 is positioned. The pair of ball bearings 32 allows each of the plurality of hanger supports 31 to easily slide along the guide rail 30 with minimum friction, thus ensuring the efficient transfer of the articles of clothing.

In further reference to FIG. 7-8, in some embodiments, the guide rail 30 comprises a guide cable 37, wherein each of the plurality of hanger supports 31 is selectively engaged with the guide cable 37. Furthermore, each of the plurality of hanger supports 31 comprises a rail stop 33, wherein the rail stop 33 allows the selected hanger support to be locked in position along the guide rail 30. As such, the rail stop 33 of each of the plurality of hanger supports 31 is selectively engaged with the guide rail 30. This allows selected articles of clothing that do not need to be folded to remain hung within the washing and drying chamber 10.

Figure 14:
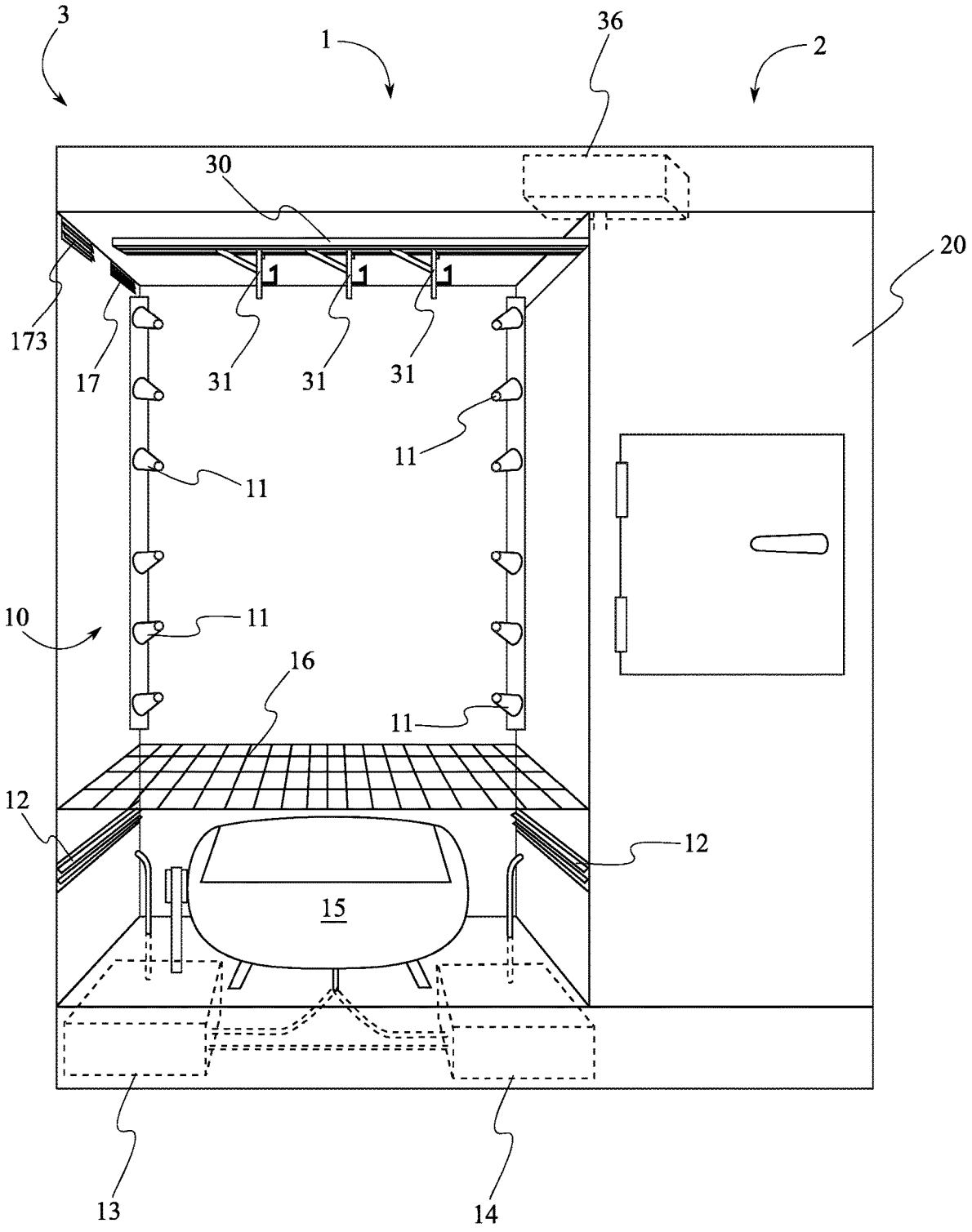
FIG. 14 is a perspective view showing the inside of one embodiment of the washing and drying chamber, wherein the guide rail is positioned along an upper side of the washing and drying chamber.
Figure 15:
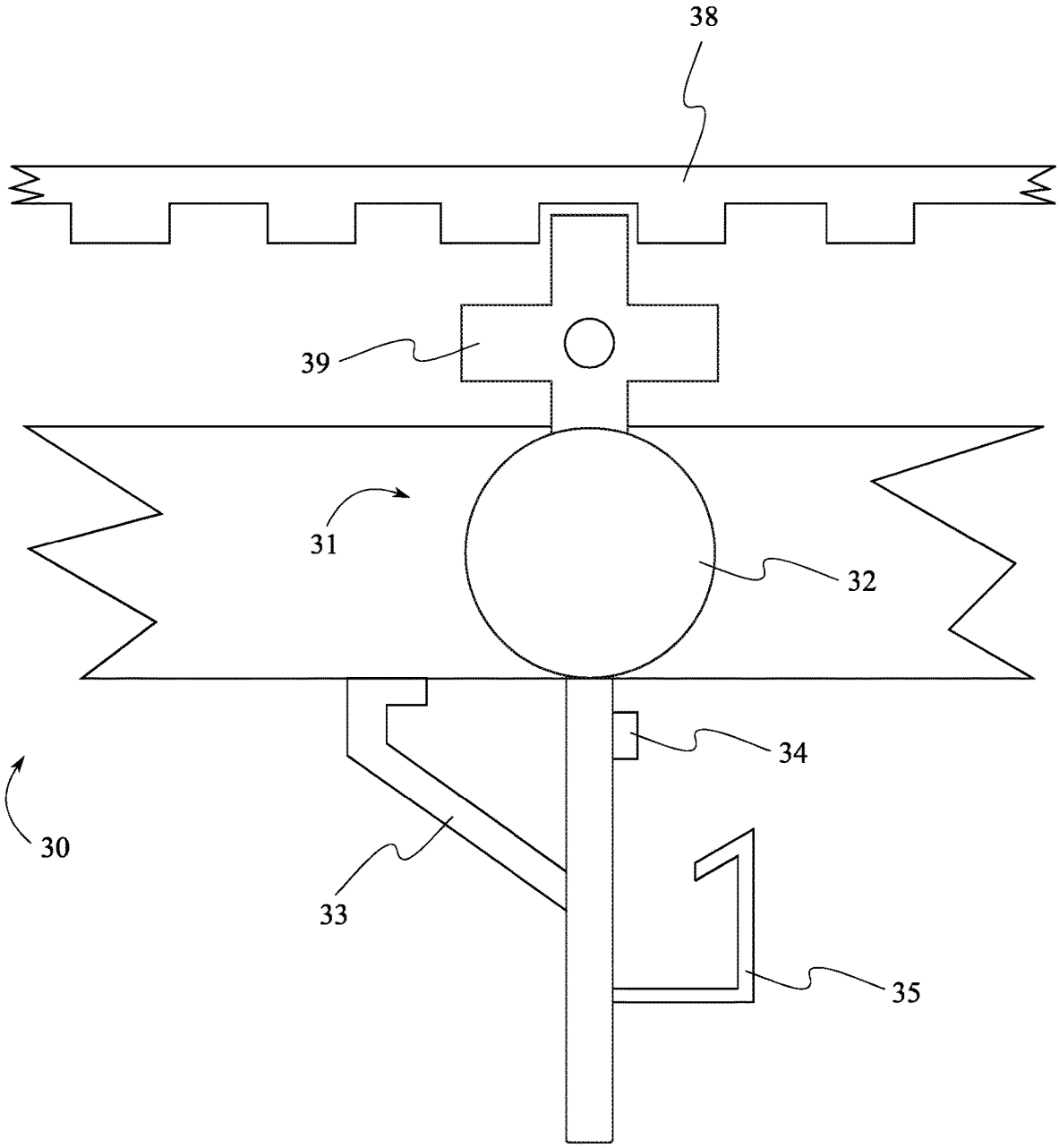
FIG. 15 is a side view of one of the plurality of hanger supports and the guide rail, wherein the motion-transfer gear is engaged between the hanger support and the toothed track.
Figure 16:
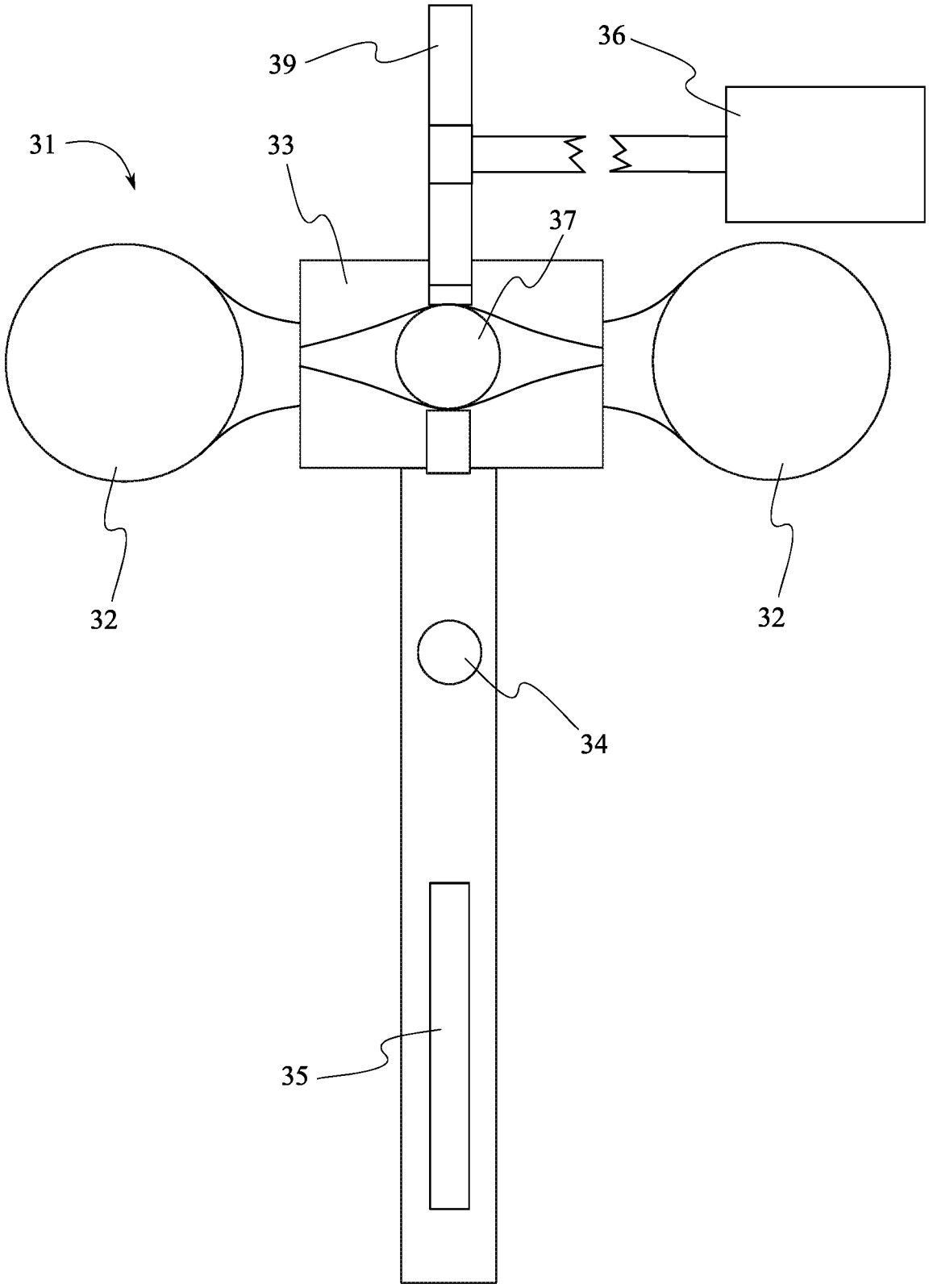
FIG. 16 is a front view of one of the plurality of hanger supports the motion transfer gear and the motor, wherein the motion-transfer gear is mechanically coupled between the hanger support and the motor.

In reference to FIG. 14-16, in some embodiments the guide rail 30 comprises a toothed track and at least one motion-transfer gear, wherein the motion-transfer gear enables the motor 36 to move the plurality of hanger supports 31 along the guide rail. Specifically, the motion-transfer gear is rotatably engaged in between the plurality of hanger supports 31 and the toothed track. As such, the motor 36 provides a rotary force that causes the motion-transfer gear to travel along the toothed track while propelling the plurality of hanger supports 31 along the guide rail 30. In the closed loop configuration, multiple motion-transfer gears are positioned around the guide rail. The motor is connected to each of the motion-transfer gears by a corresponding axle, such that the motor is able to rotate the motion-transfer gears by rotating the corresponding axles. Accordingly, the rotation of the motion transfer gears causes the plurality of hanger supports 31 to travel around the guide rail 30. Preferably, the motion-transfer gear is a cross-shaped gear.

In further reference to FIG. 7-8, in some embodiments, the rail stop 33 is a clamping mechanism that is mechanically coupled to a hanger switch 34. The rail stop 33 is positioned around the guide cable 37, such that the clamping mechanism can be closed and opened in order to engage with and disengage from the guide cable 37, as depicted in FIG. 7-8 respectively. The hanger switch 34 is used to toggle the rail stop 33 between the open position and the closed position. When the rail stop 33 is clamped onto the guide cable 37, the corresponding hanger support is conveyed along the guide rail 30. When the rail stop 33 is unclamped, the guide cable 37 is able to freely pass through the corresponding hanger support, leaving the corresponding hanger support in place.

Figure 9:
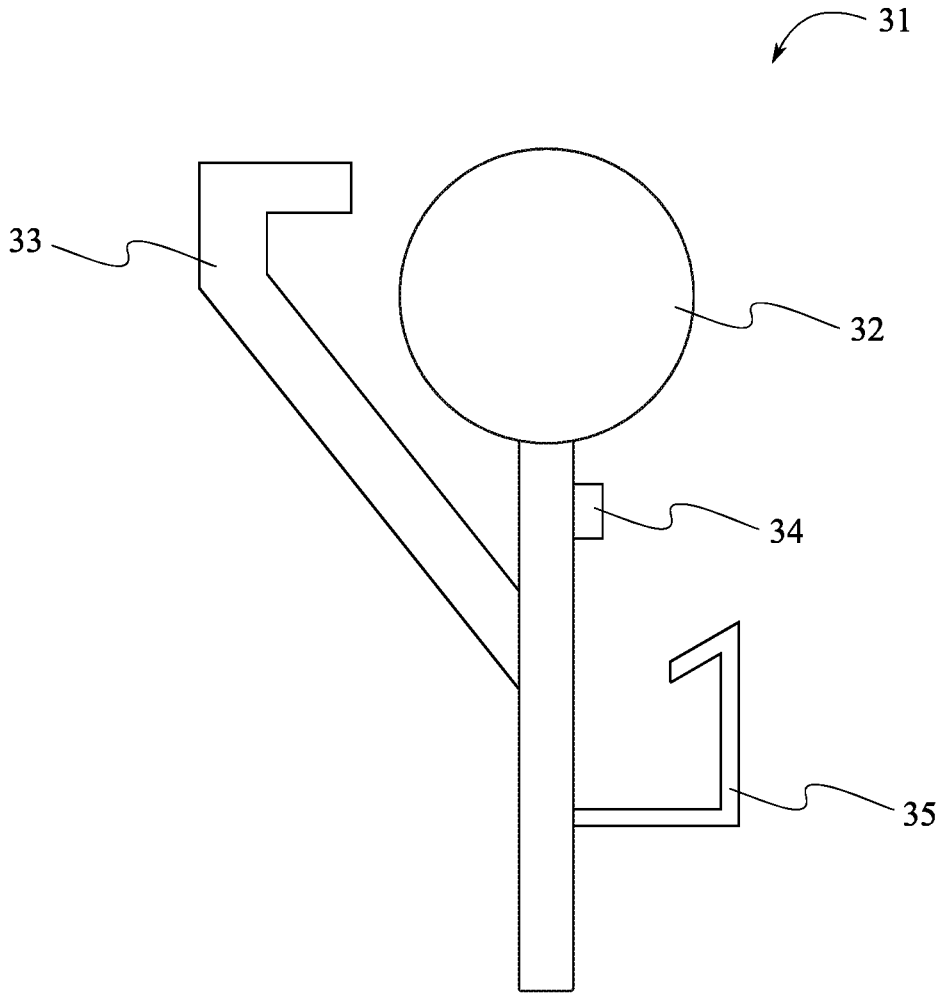
FIG. 9 is a side view of one of the plurality of hanger supports, wherein the rail stop is in an up position to engage with the guide rail.
Figure 10:
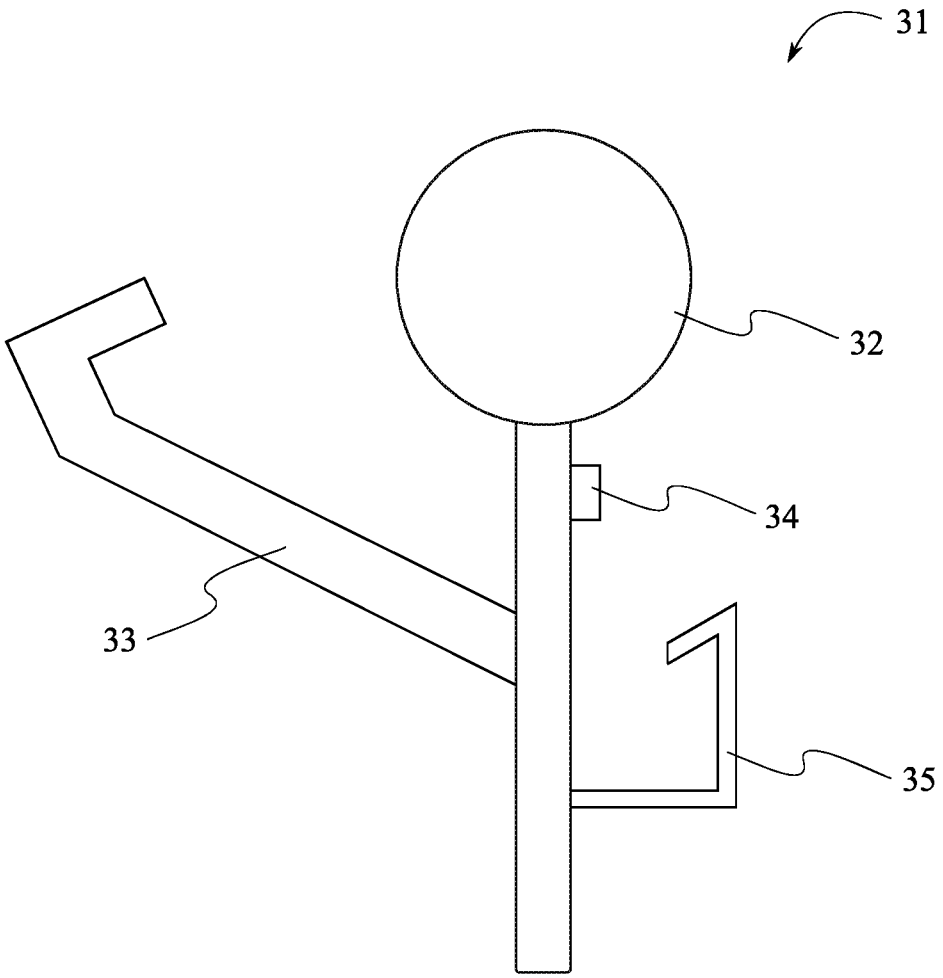
FIG. 10 is a side view of one of the plurality of hanger supports, wherein the rail stop is in a down position to disengage from the guide rail.

In reference to FIG. 9-10, in some embodiments, the rail stop 33 is a latch that is able to pivot between an up position and a down position. When the rail stop 33 is in the up position, the rail stop 33 is engaged with the guide rail 30. In turn, the rail stop 33 prevents the corresponding hanger support from moving along the guide rail 30 when the rail stop 33 is in the up position. When the rail stop 33 is in the down position, the rail stop 33 is disengaged from the guide rail 30. In turn, the corresponding hanger support is able to traverse along the guide rail 30 without interference from the rail stop 33. The hanger switch 34 may be mechanically coupled to the rail stop 33, such that the user can toggle the rail stop 33 between the up position and the down position using the hanger switch 34. In some embodiments, the rail stop 33 may be a combination of the latch and the clamping mechanism as described above.

In one embodiment, the motor 36 and the guide cable 37 form a winch, wherein the motor 36 drives a drum around which the guide cable 37 is wound and unwound. The motor 36 is positioned at one end of the guide rail 30, wherein the guide cable 37 pulls the plurality of hanger supports 31 along the guide rail 30 as the motor 36 winds the guide cable 37 around the drum. A spring mechanism, or other device capable of providing a restorative force, is positioned at the opposite end of the guide rail 30, wherein the guide cable 37 is terminally connected to the spring mechanism. To return the plurality of hanger supports 31 to an initial position, the drum is unlocked, allowing the drum to rotate freely. When the drum is unlocked, the spring mechanism, or similar device, provides the restorative force to pull the guide cable 37 and unwind the guide cable 37 from the drum.

Figure 11:
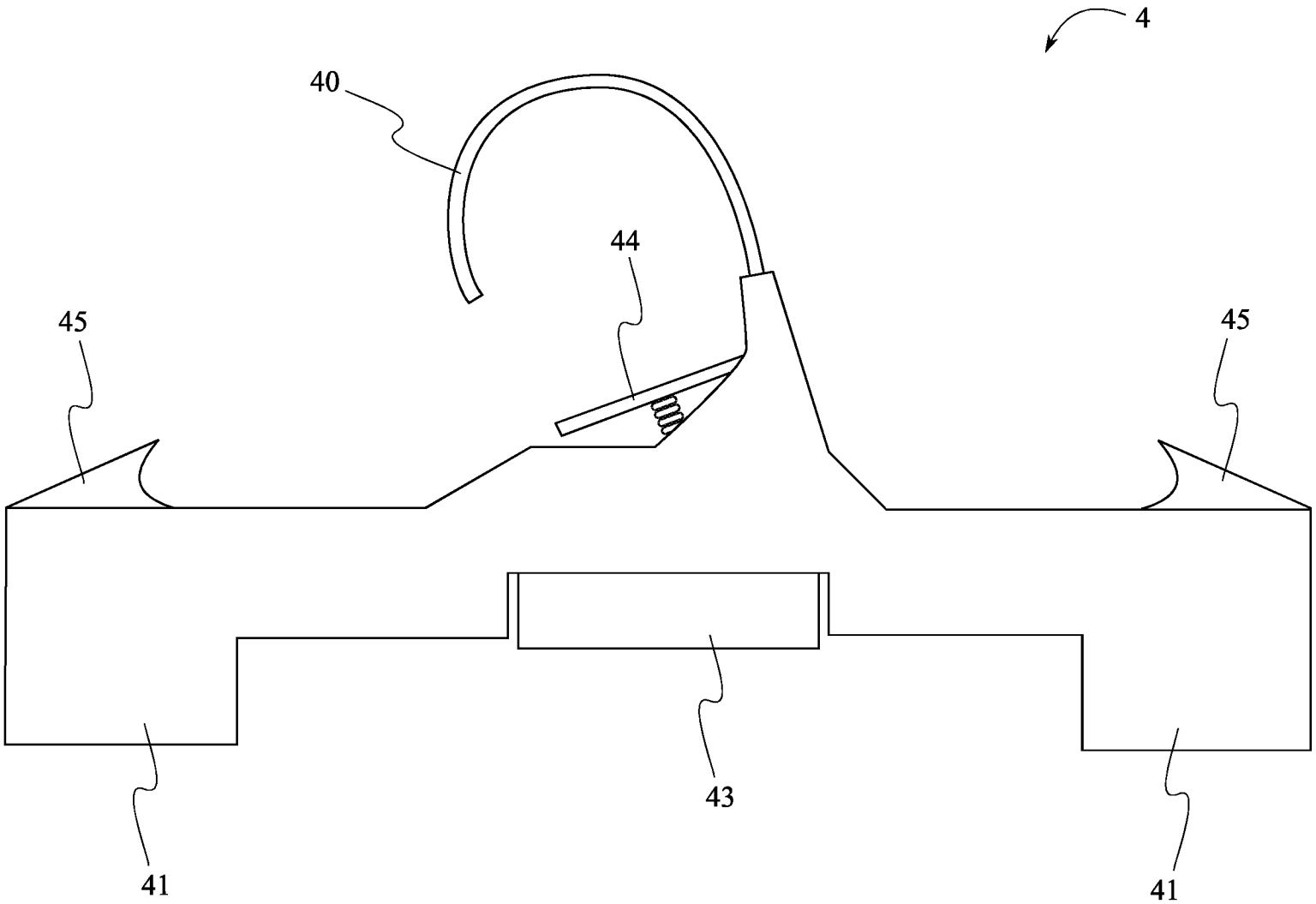
FIG. 11 is a front view of a clothing hanger, wherein the clothing hanger has a first grip-opening mechanism and a second grip-opening mechanism for opening and closing a pair of grips.

Each of the plurality of hanger supports 31 provides a means for supporting a clothing hanger 4. In reference to FIG. 11-13, the clothing hanger 4 comprises a hanger hook 40, a pair of grips 41, a first grip-opening mechanism 43, and a second grip-opening mechanism 44. The hanger hook 40 is positioned at the top of the clothing hanger 4 and allows the clothing hanger 4 to be secured to one of the plurality of hanger supports 31. Each of the plurality of hanger supports 31 comprises a support hook 35, or similar mechanism, that is capable of engaging with the clothing hanger 4 in order to support the clothing hanger 4 in a suspended position. Through the hanger hook 40 and the support hook 35, the clothing hanger 4 is removably attached to one of the plurality of hanger supports 31. Each of the pair of grips 41 is spring loaded, wherein each of the pair of grips 41 is mechanically coupled to the first grip-opening mechanism 43 and the second grip-opening mechanism 44. In this way, the first grip-opening mechanism 43 and the second grip-opening mechanism 44 may be used to open and close the pair of grips 41.

The first grip-opening mechanism 43 and the second grip-opening mechanism 44 are positioned in between each of the pair of grips 41. Furthermore, the second grip-opening mechanism 44 is positioned in between the first grip-opening mechanism 43 and the hanger hook 40. The first grip-opening mechanism 43 is selectively engaged with the hanger release mechanism 21, wherein the first grip-opening mechanism 43 engages with the hanger release mechanism 21 as the corresponding hanger support is pulled along the guide rail 30 within the folding chamber 20. When the first grip-opening mechanism 43 is pressed into the hanger release mechanism 21, each of the pair of grips 41 opens, releasing the article of clothing onto the folding machine 22. Meanwhile, the second grip-opening mechanism 44 allows a handicap individual, such as someone with one hand, to easily open or close the pair of grips 41 in order to attach or detach the article of clothing from the pair of grips 41.

Figure 12:
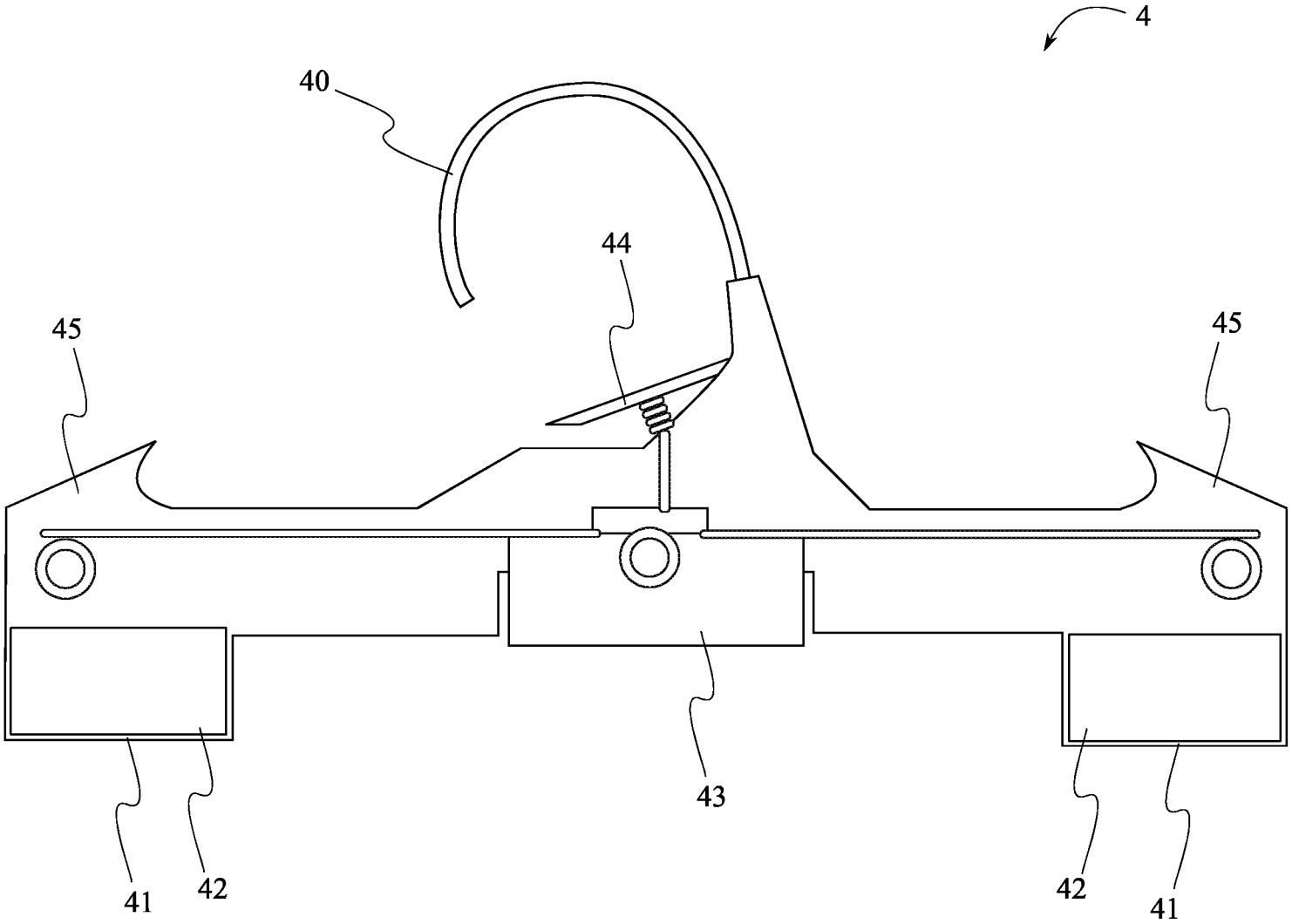
FIG. 12 is a sectional view of the clothing hanger showing the mechanical coupling between the pair of grips and both the first grip-opening mechanism and the second grip-opening mechanism.
Figure 13:
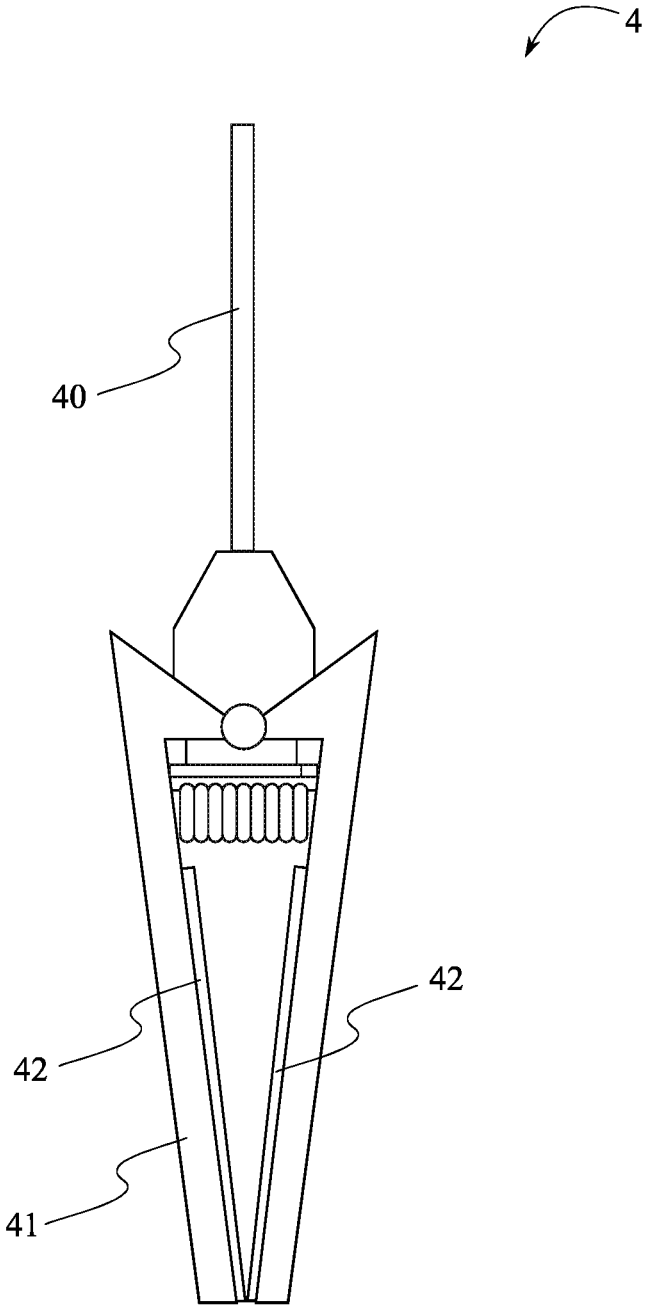
FIG. 13 is a side view of the clothing hanger showing the pair of cushions for one of the pair of grips.

In reference to FIG. 12-13, in some embodiments, each of the pair of grips 41 may include a pair of cushions 42, wherein each of the pair of cushions 42 is positioned on opposing clamping members of each of the pair of grips 41. The pair of cushions 42 helps to protect the article of clothing from being damaged while the article of clothing is hung within the washing and drying chamber 10. The pair of cushions 42 may also provide additional grip to secure the article of clothing. In some embodiments, the clothing hanger 4 may further comprise a pair of clothing hooks 45. Each of the pair of clothing hooks 45 is positioned adjacent to one of the pair of grips 41, wherein the pair of clothing hooks 45 is positioned above the pair of grips 41. The pair of clothing hooks 45 provides an additional means for securing the article of clothing to the clothing hanger 4 or a means for hanging other items to be cleaned, such as a drawstring bag.

In reference to FIG. 1, the present invention may further include a display monitor 5. The display monitor 5 is exteriorly integrated into the washing and drying chamber 10, such that the display monitor 5 is accessible and visible to the user. The display monitor 5 allows the user to view the status of the clothing being washed and folded within the washing and drying chamber 10 and the folding chamber 20, respectively. For example, the display monitor 5 might depict the wash cycle, time left before the wash cycle is completed, etc. In some embodiments, the display monitor 5 may be a touchscreen, wherein the user may select parameters such as the type of wash cycle, the water temperature, the wash time, the amount of detergent to use, etc. through the display monitor 5. In other embodiments, a set of controls is exteriorly integrated into the washing and drying chamber 10, wherein the set of controls allows the user to adjust said parameters.

In some embodiments, the present invention may further comprise a pre-spray nozzle. The pre-spray nozzle allows the user to spot treat and apply a pre-cleaning product to selected articles of clothing. The pre-spray nozzle is attached to a hose that feeds the pre-cleaning product to the pre-spray nozzle. The hose and the pre-spray nozzle may be in fluid communication with the water feed 13 in order to produce a pre-cleaning mixture from the water and the pre-cleaning product. In some embodiments, the hose and the pre-spray nozzle are located outside of the washing and drying chamber 10. A plurality of exterior hooks may also be provided to allow the user to hang the selected articles of clothing about the exterior of the washing and drying chamber 10. The user can then apply the pre-cleaning product or the pre-cleaning mixture to the selected articles of clothing before the wash cycle. In other embodiments, the hose and the pre-spray nozzle may be positioned within the washing and drying chamber 10.

Although the invention has been explained in relation to its preferred embodiment, it is to be understood that many other possible modifications and variations can be made without departing from the spirit and scope of the invention as hereinafter claimed.

What is claimed is:

1. A clothing washing, drying, and folding machine comprises:

a washing and drying unit comprising a washing and drying chamber, a plurality of pressurized nozzles, a plurality of heating vents, a water feed, and a detergent feed;

a folding unit comprising a folding chamber, a hanger release mechanism, a folding machine, and a release gate;

a clothing track system comprising a guide rail and a plurality of hanger supports;

the plurality of pressurized nozzles being positioned along the walls of the washing and drying chamber;

the plurality of pressurized nozzles being in fluid communication with both the water feed and the detergent feed;

the plurality of heating vents being integrated into the walls of the washing and drying chamber;

the folding unit being positioned adjacent to the washing and drying unit;

the guide rail traversing from the washing and drying chamber into the folding chamber;

the plurality of hanger supports being linearly dispersed along the guide rail; and the folding machine being positioned in between the hanger release mechanism and the release gate.

2. The clothing washing, drying, and folding machine as claimed in claim 1 comprises:

the washing and drying unit further comprising a washer and dryer cage; and the washer and dryer cage being positioned below the plurality of pressurized nozzles.

3. The clothing washing, drying, and folding machine as claimed in claim 2 comprises:

the washing and drying unit further comprising a separation gate; and the separation gate being positioned in between the washer and dryer cage and the plurality of pressurized nozzles.

4. The clothing washing, drying, and folding machine as claimed in claim 3 comprises:

the separation gate being pivotally connected to one of the walls of the washing and drying chamber.

5. The clothing washing, drying, and folding machine as claimed in claim 2 comprises:

the washer and dryer cage being in fluid communication with both the water feed and the detergent feed.

6. The clothing washing, drying, and folding machine as claimed in claim 1 comprises:

the plurality of heating vents being positioned below the plurality of pressurized nozzles.

7. The clothing washing, drying, and folding machine as claimed in claim 1 comprises:

the clothing track system further comprising a motor; and the motor being mechanically coupled to the guide rail in order to convert rotational motion of the motor to linear motion along the guide rail.

8. The clothing washing, drying, and folding machine as claimed in claim 7 comprises:

the motor being housed above the washing and drying unit and the folding unit.

9. The clothing washing, drying, and folding machine as claimed in claim 1 comprises:

a clothing hanger comprising a first grip-opening mechanism;

the clothing hanger being removably attached to one of the plurality of hanger supports; and the first grip-opening mechanism being selectively engaged with the hanger release mechanism.

10. The clothing washing, drying, and folding machine as claimed in claim 1 comprises:

a display monitor; and the display monitor being exteriorly integrated into the washing and drying chamber.

11. The clothing washing, drying, and folding machine as claimed in claim 1 comprises:

a clothing transfer opening; and the clothing transfer opening being positioned in between the washing and drying chamber and the folding chamber.

12. The clothing washing, drying, and folding machine as claimed in claim 1 comprises:

the folding machine comprising a first plurality of folding arms and a second plurality of folding arms; and the first plurality of folding arms being positioned perpendicular to the second plurality of folding arms.

13. The clothing washing, drying, and folding machine as claimed in claim 12 comprises:

the first plurality of folding arms comprising a first manipulator and a second manipulator;

the first manipulator and the second manipulator being laterally offset from each other; and the first manipulator and the second manipulator being laterally actuatable within the folding chamber.

14. The clothing washing, drying, and folding machine as claimed in claim 12 comprises:

the second plurality of folding arms comprising a third manipulator; and the third manipulator being laterally actuatable within the folding chamber.

15. The clothing washing, drying, and folding machine as claimed in claim 1 comprises:

the guide rail comprising a guide cable; and each of the plurality of hanger supports being selectively engaged with the guide cable.

16. The clothing washing, drying, and folding machine as claimed in claim 1 comprises:

the guide rail comprising a toothed track and at least one motion-transfer gear; and the motion-transfer gear being rotatably engaged between the plurality of hanger supports and the toothed track.

17. The clothing washing, drying, and folding machine as claimed in claim 1 comprises:

each of the plurality of hanger supports comprising a pair of ball bearings; and the pair of ball bearings being slidably engaged with the guide rail.

18. The clothing washing, drying, and folding machine as claimed in claim 1 comprises:

each of the plurality of hanger supports comprising a rail stop; and the rail stop being selectively engaged with the guide rail.

* * * * *